US008344714B2

(12) United States Patent
Huang

(10) Patent No.: US 8,344,714 B2
(45) Date of Patent: Jan. 1, 2013

(54) LINEAR VOLTAGE REGULATOR CIRCUIT WITH POWER SAVING CAPABILITY

(75) Inventor: Yong-Zhao Huang, Shenzhen (CN)

(73) Assignees: Hong Fu Jin Precision Industry (ShenZhen) Co., Ltd., Shenzhen (CN); Hon Hai Precision Industry Co., Ltd., New Taipei (TW)

( * ) Notice: Subject to any disclaimer, the term of this patent is extended or adjusted under 35 U.S.C. 154(b) by 443 days.

(21) Appl. No.: 12/696,016

(22) Filed: Jan. 28, 2010

(65) Prior Publication Data

US 2011/0127984 A1 Jun. 2, 2011

(30) Foreign Application Priority Data

Dec. 1, 2009 (CN) ..... 2009 1 0310734

(51) Int. Cl.
*G05F 1/565* (2006.01)

(52) U.S. Cl. ..... 323/274; 307/87; 307/130

(58) Field of Classification Search ..... 323/274, 323/273, 281; 307/87, 80–81, 85–86, 130
See application file for complete search history.

(56) References Cited

U.S. PATENT DOCUMENTS 5,945,816 A * 8/1999 Marusik ..... 323/273
6,060,789 A * 5/2000 Yamaguchi ..... 307/66
6,097,178 A * 8/2000 Owen et al. ..... 323/273
7,148,587 B2 * 12/2006 Matsuda et al. ..... 307/80
7,705,575 B2 * 4/2010 Akyildiz et al. ..... 323/281

* cited by examiner

*Primary Examiner* — Harry Behm
(74) *Attorney, Agent, or Firm* — Altis Law Group, Inc.

(57) ABSTRACT

A linear voltage regulator circuit includes first and second voltage input terminals to receive a first or second external voltage, a voltage output terminal, a voltage regulator unit, a voltage switch unit, and a voltage detecting unit. The voltage regulator unit selectively receives the first or second external voltage controlled by the voltage switch unit. The voltage detecting unit outputs a first control signal to control the voltage switch unit to output the first external voltage to the voltage regulator unit, in response to an output voltage of the voltage output terminal being less than or equal to a predetermined value. The voltage detecting unit outputs a second control signal to control the voltage switch unit to output the second external voltage to the voltage regulator unit in response to the output voltage being greater than the predetermined value.

9 Claims, 3 Drawing Sheets

LINEAR VOLTAGE REGULATOR CIRCUIT WITH POWER SAVING CAPABILITY

BACKGROUND

1. Technical Field

The present disclosure relates to voltage regulator circuits and, particularly, to a linear voltage regulator circuit with efficient power management capability.

2. Description of Related Art

A linear voltage regulator circuit is used to connect a voltage input terminal and a voltage output terminal. The voltage input terminal is used for receiving an external voltage, such as 1.5 volts (V). The linear voltage regulator is used to regulate the external voltage to a stabilized voltage, such as a 1.2 V stabilized voltage, and then output the stabilized voltage to an electronic device through the voltage output terminal. A conversion efficiency of the linear voltage regulator circuit is equal to the stabilized voltage (namely, an input voltage of the electronic device) divided by the external voltage, which is 1.2/1.5=80%.

However, the external voltage may be a fixed value, if the input voltage of the electronic device is decreased, such as from 1.2V to 0.8V, the conversion efficiency of the linear voltage regulator circuit is also decreased to for example, from 80% to 0.8V/1.5V=53.3%, which wastes power.

DETAILED DESCRIPTION

Figure 1:
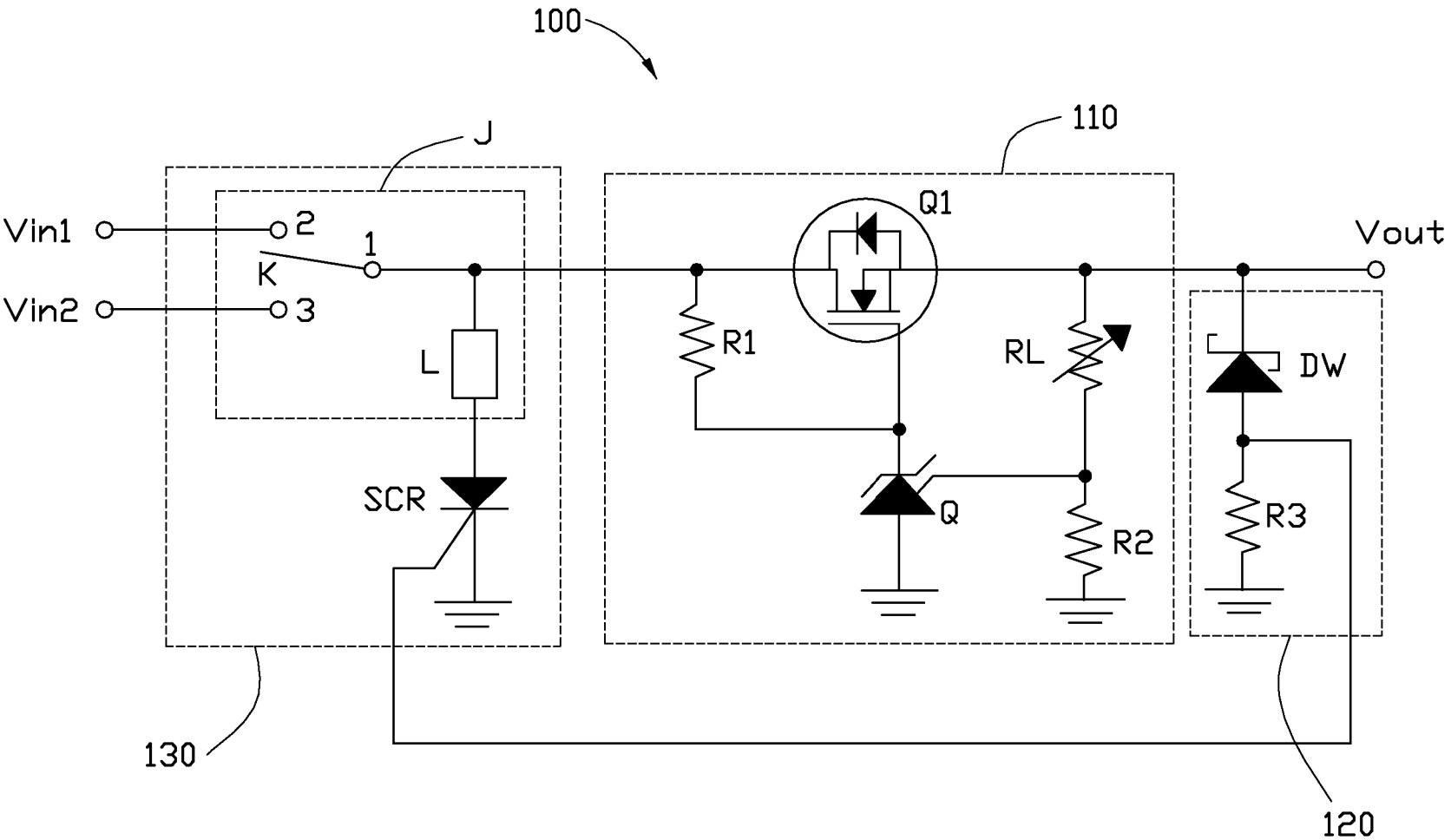
FIG. 1 is a circuit diagram of a first exemplary embodiment of a linear voltage regulator circuit.

Referring to FIG. 1, a first exemplary embodiment of a linear voltage regulator circuit 100 includes a first voltage input terminal $V_{in}$1, a second voltage input terminal $V_{in}$2, a voltage regulator unit 110, a voltage detecting unit 120, a voltage switch unit 130, and a voltage output terminal $V_{out}$.

The voltage regulator unit 110 includes a P-channel metal-oxide semiconductor (PMOS) transistor Q1, a TL431 shunt regulator Q, two resistors R1 and R2, and an adjustable resistor RL. The voltage detecting unit 120 includes a Zener diode DW and a resistor R3. The voltage switch unit 130 includes a relay J and a thyristor SCR. The relay J includes a coil L and a single-pole double-throw (SPDT) switch K having a pole 1, a first throw 2, and a second throw 3.

The first and second voltage input terminals $V_{in}$1 and $V_{in}$2 are used to receive two different first and second external voltages, such as a 1.5 volt (V) voltage and a 2.0V voltage, respectively. The first voltage input terminal $V_{in}$1 is connected to the first throw 2 of the switch K. The second voltage input terminal $V_{in}$2 is connected to the second throw 3 of the switch K. The pole 1 of the switch K is connected to a drain of the transistor Q1, connected to an anode of the thyristor SCR via the coil L, and connected to a gate of the transistor Q1 via the resistor R1. A cathode of the thyristor SCR is grounded. The gate of the transistor Q1 is also connected to a cathode of the shunt regulator Q. An anode of the shunt regulator Q is grounded. A source of the transistor Q1 is connected to the voltage output terminal $V_{out}$, grounded via the adjustable resistor RL and the resistor R2 in series, and connected to a cathode of the Zener diode DW. A node between the adjustable resistor RL and the resistor R2 is connected to a reference terminal of the shunt regulator Q. An anode of the Zener diode DW is grounded via the resistor R3, and connected to a control terminal of the thyristor SCR.

In use, at the beginning, the pole 1 is electrically connected to the throw 2 of the switch K. The voltage regulator unit 110 receives the first external voltage, such as 1.5V, from the first voltage input terminal $V_{in}$1, and regulates the first external voltage to a stabilized voltage, such as 1.2V, to the voltage output terminal $V_{out}$, to supply the stabilized voltage to an electronic device (not shown) connected to the voltage output terminal $V_{out}$. At this time, the stabilized voltage is less than or equal to a breakdown voltage of the Zener diode DW. The Zener diode DW is turned off, therefore the thyristor SCR is not triggered. The relay J is not activated, the voltage output terminal $V_{out}$ continually outputs the stabilized voltage to the electronic device. The conversion efficiency of the linear voltage regulator circuit 100 is equal to the stabilized voltage divided by the first external voltage, such as 1.2/1.5=80%.

If the stabilized voltage is increased to meet a demand of the electronic device during operation, such as an increase to 1.6V, the stabilized voltage is greater than the breakdown voltage of the Zener diode DW. The Zener diode DW is turned on, therefore the thyristor SCR is triggered. The relay J is activated to control the throw 3 to be electrically connected to the pole 1 of the switch K, therefore, the voltage regulator unit 110 receives a second external voltage, such as 2.0V, from the second voltage input terminal $V_{in}$2. The conversion efficiency of the linear voltage regulator circuit 100 is equal to the stabilized voltage divided by the second external voltage, such as 1.6V/2.0V=80%, which remains unchanged.

If the stabilized voltage is decreased consistent with the electronic device's overload status such as a decrease to 1.2V, the stabilized voltage is less than or equal to the breakdown voltage of the Zener diode DW. The Zener diode DW is turned off, therefore the thyristor SCR is not triggered. The relay J is not activated and the throw 2 is electrically connected to the pole 1 of the switch K again, therefore, the voltage regulator unit 110 receives the first external voltage from the first voltage input terminal $V_{in}$1. The conversion efficiency of the linear voltage regulator circuit 100 is equal to the stabilized voltage divided by the first external voltage, which also remains unchanged, thereby saving power efficiently.

Figure 2:
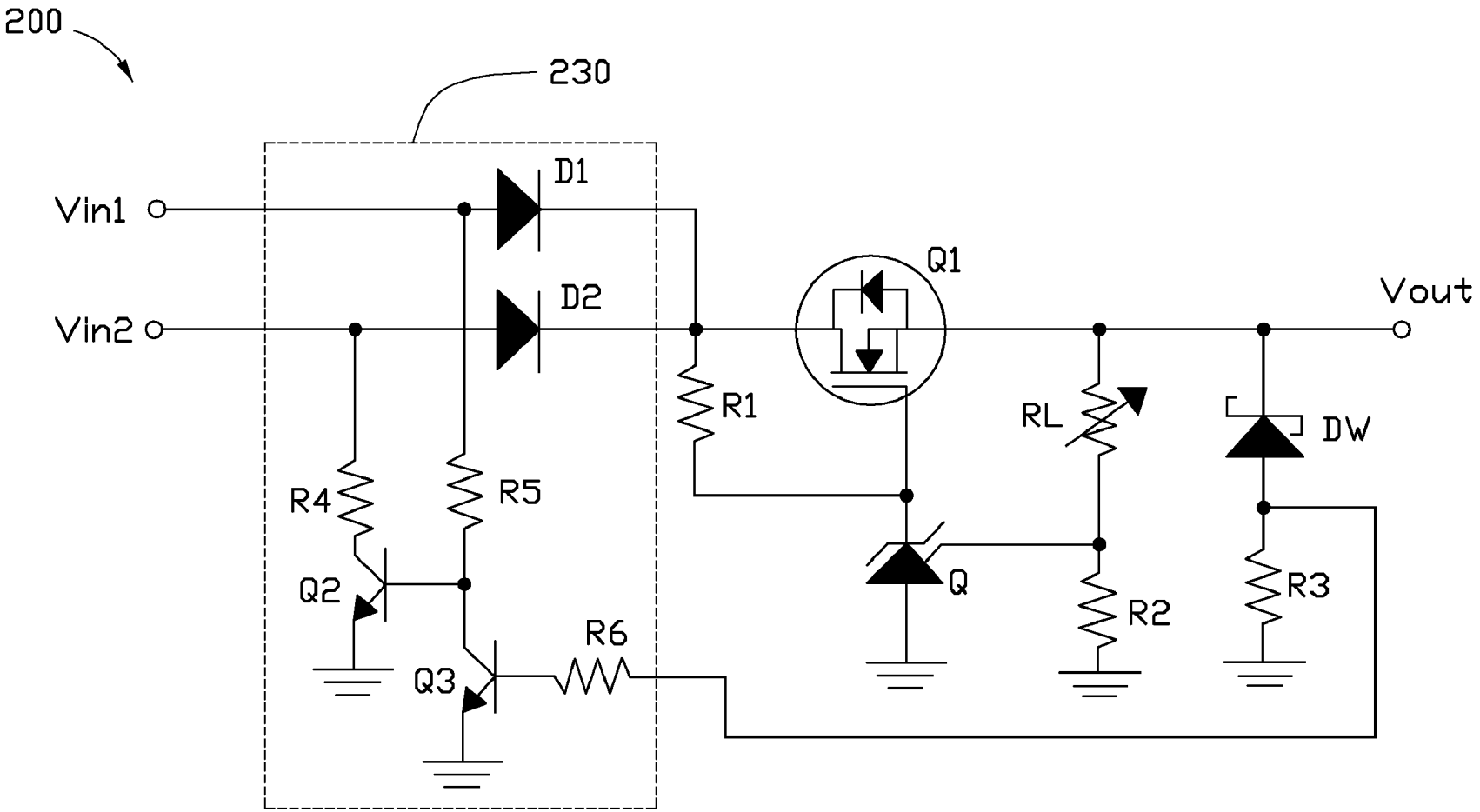
FIG. 2 is a circuit diagram of a second exemplary embodiment of a linear voltage regulator circuit.

Referring to FIG. 2, a second exemplary embodiment of a linear voltage regulator circuit 200 is shown. The linear voltage regulator circuit 200 is generally similar to the linear voltage regulator circuit 100, except that a voltage switch unit 230 of the linear voltage regulator circuit 200 is different from the voltage switch unit 130 of the linear voltage regulator circuit 100. The voltage switch unit 230 includes two diodes D1 and D2, two transistors Q2 and Q3, and three resistors R4-R6. The first voltage input terminal $V_{in}$1 is connected to an anode of the diode D1. A cathode of the diode D1 is connected to the drain of the transistor Q1, and connected to the gate of the transistor Q1 via the resistor R1. The second voltage input terminal $V_{in}$2 is connected to an anode of the diode D2. A cathode of the diode D2 is connected to the drain of the transistor Q1. The first voltage input terminal $V_{in}$1 is also connected to a collector of the transistor Q3 and a base of the transistor Q2 via the resistor R5. An emitter of the transistor Q3 is grounded. A base of the transistor Q3 is connected to the anode of the Zener diode DW via the resistor R6. The second voltage input terminal $V_{in}$2 is also connected to a collector of the transistor Q2 via the resistor R4. An emitter of the transistor Q2 is grounded.

In use, at the beginning, the voltage regulator unit 110 receives the first external voltage from the first voltage input terminal $V_{in}$1, and the transistor Q2 is turned on and the transistor Q3 is turned off. When the stabilized voltage is increased, the transistor Q3 is turned on and the transistor Q2 is turned off, the voltage regulator unit 110 receives the second external voltage from the second voltage input terminal $V_{in}$2. When the stabilized voltage decreases again, the transistor Q2 is turned on and the transistor Q3 is turned off, the voltage regulator unit 110 receives the first external voltage from the first voltage input terminal $V_{in}$1 again.

Figure 3:
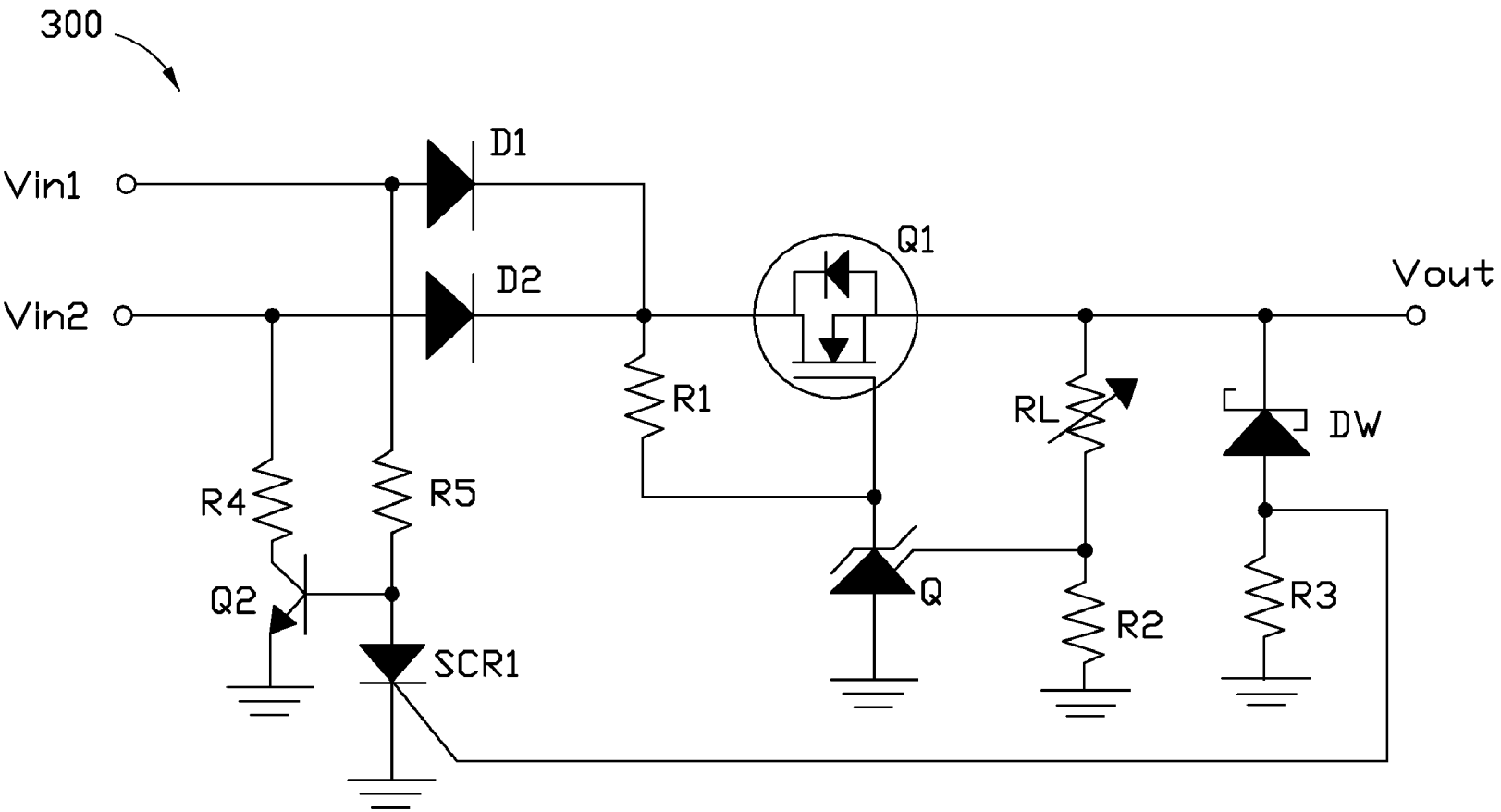
FIG. 3 is a circuit diagram of a third exemplary embodiment of a linear voltage regulator circuit.

Referring to FIG. 3, a third exemplary embodiment of a linear voltage regulator circuit 300 is shown. The linear voltage regulator circuit 300 is generally similar to the linear voltage regulator circuit 200, except that a thyristor SCR1 is used in place of the transistor Q3, and the resistor R6 of the linear voltage regulator circuit 200 is omitted. An anode, a cathode, and a control terminal of the thyristor SCR1 are corresponding to the collector, the emitter, and the base of the transistor Q3, respectively. The work process of the linear voltage regulator circuit 300 is similar to that of the linear voltage regulator circuit 200.

It is to be understood, however, that even though numerous characteristics and advantages of the embodiments have been set forth in the foregoing description, together with details of the structure and function of the embodiments, the disclosure is illustrative only, and changes may be made in details, especially in matters of shape, size, and arrangement of parts within the principles of the embodiments to the full extent indicated by the broad general meaning of the terms in which the appended claims are expressed.

What is claimed is:

1. A linear voltage regulator circuit comprising:

a first voltage input terminal to receive a first external voltage;

a second voltage input terminal to receive a second external voltage which is greater than the first external voltage;

a voltage output terminal;

a voltage switch unit connected to the first and second voltage input terminals, wherein the voltage switch unit comprises a relay and a thyristor; the relay comprises a coil and a single-pole double-throw switch having a pole, a first throw, and a second throw; the first throw of the switch is connected to the first voltage input terminal, the second throw of the switch is connected to the second voltage input terminal, the pole of the switch is connected to an anode of the thyristor via the coil, a cathode of the thyristor is grounded;

a voltage regulator unit connected to the pole of the switch of the relay of the voltage switch unit, to selectively receive the first or second external voltage from the voltage switch unit, and output the selected one of the first and second external voltages through the voltage output terminal; and a voltage detecting unit to detect an output voltage of the voltage output terminal and connected to a control terminal of the thyristor of the voltage switch unit, wherein the voltage detecting unit outputs a first control signal to the control terminal of the thyristor for controlling the voltage switch unit to output the first external voltage to the voltage regulator unit, in response to the output voltage being less than or equal to a predetermined value, wherein the voltage detecting unit outputs a second control signal to the control terminal of the thyristor for controlling the voltage switch unit to output the second external voltage to the voltage regulator unit, in response to the output voltage being greater than the predetermined value.

2. The linear voltage regulator circuit of claim 1, wherein the voltage regulator unit comprises a P-channel metal-oxide semiconductor (PMOS) transistor, a shunt regulator, a first resistor, a second resistor, and an adjustable resistor, a drain of the PMOS transistor is connected to the voltage switch unit, the first resistor is connected between the drain and a gate of the PMOS transistor, the gate of the PMOS transistor is also connected to a cathode of the shunt regulator, an anode of the shunt regulator is grounded, a source of the PMOS transistor is connected to the voltage output terminal and grounded via the adjustable resistor and the second resistor in series, a reference terminal of the shunt regulator is connected to a node between the adjustable resistor and the second resistor.

3. The linear voltage regulator circuit of claim 1, wherein the voltage detecting unit comprises a Zener diode and a resistor, a cathode of the Zener diode is connected to the voltage output terminal, an anode of the Zener diode is grounded via the resistor, the anode of the Zener diode is also connected to the voltage switch unit, to output the first or second control signal to control the voltage switch unit, the predetermined value is a breakdown voltage of the Zener diode.

4. A linear voltage regulator circuit comprising:

a first voltage input terminal to receive a first external voltage;

a second voltage input terminal to receive a second external voltage which is greater than the first external voltage;

a voltage output terminal;

a voltage switch unit connected to the first and second voltage input terminals, wherein the voltage switch unit comprises a first diode, a second diode, a first transistor, a second transistor, and first to third resistors; an anode of the first diode is connected to the first voltage input terminal, an anode of the second diode is connected to the second voltage input terminal, the anode of the first diode is also connected to a collector of the first transistor via the first resistor, an emitter of the first transistor is grounded, the anode of the second diode is connected to a collector of the second transistor via the second resistor, an emitter of the second transistor is grounded, a base of the second transistor is connected the collector of the first transistor;

a voltage regulator unit connected to cathodes of the first and second diodes of the voltage switch unit, to selectively receive the first or second external voltage from the voltage switch unit, and output the selected one of the first and second external voltages through the voltage output terminal; and a voltage detecting unit to detect an output voltage of the voltage output terminal and connected to a base of the first transistor via the third resistor, wherein the voltage detecting unit outputs a first control signal to the base of the first transistor for controlling the voltage switch unit to output the first external voltage to the voltage regulator unit, in response to the output voltage being less than or equal to a predetermined value, and wherein the voltage detecting unit outputs a second control signal to the base of the first transistor for controlling the voltage switch unit to output the second external voltage to the voltage regulator unit, in response to the output voltage being greater than the predetermined value.

5. The linear voltage regulator circuit of claim 4, wherein the voltage regulator unit comprises a P-channel metal-oxide semiconductor (PMOS) transistor, a shunt regulator, a first resistor, a second resistor, and an adjustable resistor, a drain of the PMOS transistor is connected to the voltage switch unit, the first resistor is connected between the drain and a gate of the PMOS transistor, the gate of the PMOS transistor is also connected to a cathode of the shunt regulator, an anode of the shunt regulator is grounded, a source of the PMOS transistor is connected to the voltage output terminal and grounded via the adjustable resistor and the second resistor in series, a reference terminal of the shunt regulator is connected to a node between the adjustable resistor and the second resistor.

6. The linear voltage regulator circuit of claim 4, wherein the voltage detecting unit comprises a Zener diode and a resistor, a cathode of the Zener diode is connected to the voltage output terminal, an anode of the Zener diode is grounded via the resistor, the anode of the Zener diode is also connected to the voltage switch unit, to output the first or second control signal to control the voltage switch unit, the predetermined value is a breakdown voltage of the Zener diode.

7. A linear voltage regulator circuit comprising:

a first voltage input terminal to receive a first external voltage;

a second voltage input terminal to receive a second external voltage which is greater than the first external voltage;

a voltage output terminal;

a voltage switch unit connected to the first and second voltage input terminals, wherein the voltage switch unit comprises a first diode, a second diode, a transistor, a thyristor, a first resistor, and a second resistor, an anode of the first diode is connected to the first voltage input terminal, an anode of the second diode is connected to the second voltage input terminal, the anode of the first diode is also connected to an anode of the thyristor via the first resistor, a cathode of the thyristor is grounded, the anode of the second diode is also connected to a collector of the transistor via the second resistor, an emitter of the first transistor is grounded, a base of the transistor is connected the anode of the thyristor;

a voltage regulator unit connected to cathodes of the first and second diodes, to selectively receive the first or second external voltage from the voltage switch unit, and output the selected one of the first and second external voltages through the voltage output terminal; and a voltage detecting unit to detect an output voltage of the voltage output terminal and connected to a control terminal of the thyristor of the voltage switch unit, wherein the voltage detecting unit outputs a first control signal to the control terminal of the thyristor for controlling the voltage switch unit to output the first external voltage to the voltage regulator unit, in response to the output voltage being less than or equal to a predetermined value, wherein the voltage detecting unit outputs a second control signal to the control terminal of the thyristor for controlling the voltage switch unit to output the second external voltage to the voltage regulator unit, in response to the output voltage being greater than the predetermined value.

8. The linear voltage regulator circuit of claim 7, wherein the voltage regulator unit comprises a P-channel metal-oxide semiconductor (PMOS) transistor, a shunt regulator, a first resistor, a second resistor, and an adjustable resistor, a drain of the PMOS transistor is connected to the voltage switch unit, the first resistor is connected between the drain and a gate of the PMOS transistor, the gate of the PMOS transistor is also connected to a cathode of the shunt regulator, an anode of the shunt regulator is grounded, a source of the PMOS transistor is connected to the voltage output terminal and grounded via the adjustable resistor and the second resistor in series, a reference terminal of the shunt regulator is connected to a node between the adjustable resistor and the second resistor.

9. The linear voltage regulator circuit of claim 7, wherein the voltage detecting unit comprises a Zener diode and a resistor, a cathode of the Zener diode is connected to the voltage output terminal, an anode of the Zener diode is grounded via the resistor, the anode of the Zener diode is also connected to the voltage switch unit, to output the first or second control signal to control the voltage switch unit, the predetermined value is a breakdown voltage of the Zener diode.

* * * * *